US006494069B1

(12) United States Patent
Ireblad et al.

(10) Patent No.: US 6,494,069 B1
(45) Date of Patent: Dec. 17, 2002

(54) LOCK CYLINDER

(75) Inventors: Lars Ireblad, Upplands Väsby (SE); Heniz Spiegelberg, Täby (SE)

(73) Assignee: Sandvik AB (SE)

( * ) Notice: Subject to any disclaimer, the term of this patent is extended or adjusted under 35 U.S.C. 154(b) by 0 days.

(21) Appl. No.: 09/605,645

(22) Filed: Jun. 29, 2000

(30) Foreign Application Priority Data

Jul. 1, 1999 (SE) ..... 9902507

(51) Int. Cl.[7] ..... E05B 17/04; E05B 9/10
(52) U.S. Cl. ..... 70/379 R; 70/386; 42/70.11
(58) Field of Search ..... 70/31–34, 386, 70/419, 379 R; 42/70.11, 70.01, 70.02

(56) References Cited

U.S. PATENT DOCUMENTS

| | | | | |
|---|---|---|---|---|
| 1,579,736 A | | 6/1926 | Stone | |
| 3,765,115 A | | 10/1973 | Johansson et al. | 42/1 N |
| 4,040,279 A | * | 8/1977 | Signorelli et al. | 70/34 |
| 4,614,097 A | * | 9/1986 | Signorelli | 70/34 |
| 5,050,413 A | * | 9/1991 | Stillwagon et al. | 70/386 |
| 5,263,348 A | | 11/1993 | Wittwer | 70/379 R |
| 5,295,377 A | * | 3/1994 | Moricz et al. | 70/379 R |
| 5,331,759 A | | 7/1994 | Marceau | 42/70.11 |
| 5,335,520 A | | 8/1994 | Lee | 70/349 |
| 5,357,704 A | | 10/1994 | Benkovic | 42/70.11 |
| 5,664,445 A | * | 9/1997 | Chang | 70/34 |
| 5,680,723 A | | 10/1997 | Ruiz | 42/70.11 |
| 6,308,450 B1 | * | 10/2001 | Ireblad et al. | 42/70.11 |

FOREIGN PATENT DOCUMENTS

| | | |
|---|---|---|
| EP | 617184 | 9/1994 |
| SE | 505705 | 9/1997 |

* cited by examiner

*Primary Examiner*—Anthony Knight
*Assistant Examiner*—John B. Walsh
(74) *Attorney, Agent, or Firm*—Burns, Doane, Swecker & Mathis, L.L.P.

(57) ABSTRACT

The present invention relates to a lock cylinder including an outer cylindric block, an inner cylindric block, which defines a key hole, locking function members arranged inside the inner cylindric block, which are intended to cooperate with a key insertable in the key hole, as well as an activating member connected to the inner cylindric block. The inner cylindric block has such dimensions that it is displaceable inside the outer cylindric block, that members are arranged adjacent to the opening of the key hole to fix the inner cylindric block and the outer cylindric block in relation to each other in the axial direction, and a force-exerting member is provided, which applies an axial force to the inner cylindric block in a direction away from the opening of the key hole.

19 Claims, 4 Drawing Sheets

C - C

LOCK CYLINDER

TECHNICAL FIELD OF THE INVENTION

The present invention relates to a lock cylinder including an outer cylindric block, an inner cylindric block, which defines a key hole, locking function members arranged inside the inner cylindric block, which members are intended to co-operate with a key insertable in the key hole, as well as an activating member going out from the inner cylindric block.

PRIOR ART

Lock cylinders of the above-mentioned type are previously well-known and existing on the market, one of the most well-known trademarks for such lock cylinders being ABLOY®.

A disadvantage with the known lock cylinders in question is that they relatively simply may be exposed to violence with the purpose of neutralising the locking function of the lock cylinder. As examples of such violence, boring by means of a boring machine and/or cutting by means of a cross-cutting saw should be mentioned. When, for instance, boring into the key hole of the lock cylinder, the so called locking function washers in the inner cylindric block are drilled in pieces, after which these may be picked out from the inner cylindric block, which then may be turned. In that connection, also the so called activating member will be activated, the lock cylinder being possible to open.

OBJECTS AND FEATURES OF THE INVENTION

A primary object of the present invention is to define a lock cylinder of the kind defined by way of introduction which, at in principle all outer damage, should guarantee that the locking device, in which the lock cylinder is included, will not lose the locking function thereof.

Another object of the lock cylinder according to the present invention is that the same should be relatively simple in the construction thereof.

A further object of the lock cylinder according to the present invention is that it should be possible to include it in locking devices of different types, for instance such which are activated purely mechanically or such which are activated electrically.

BRIEF DESCRIPTION OF THE DRAWINGS

Below an embodiment of the lock cylinder according to the present invention will be described, reference being made to the accompanying drawings, where.

DETAILED DESCRIPTION OF A PREFERRED EMBODIMENT OF THE LOCK

CYLINDER ACCORDING TO THE PRESENT INVENTION

Figure 1:
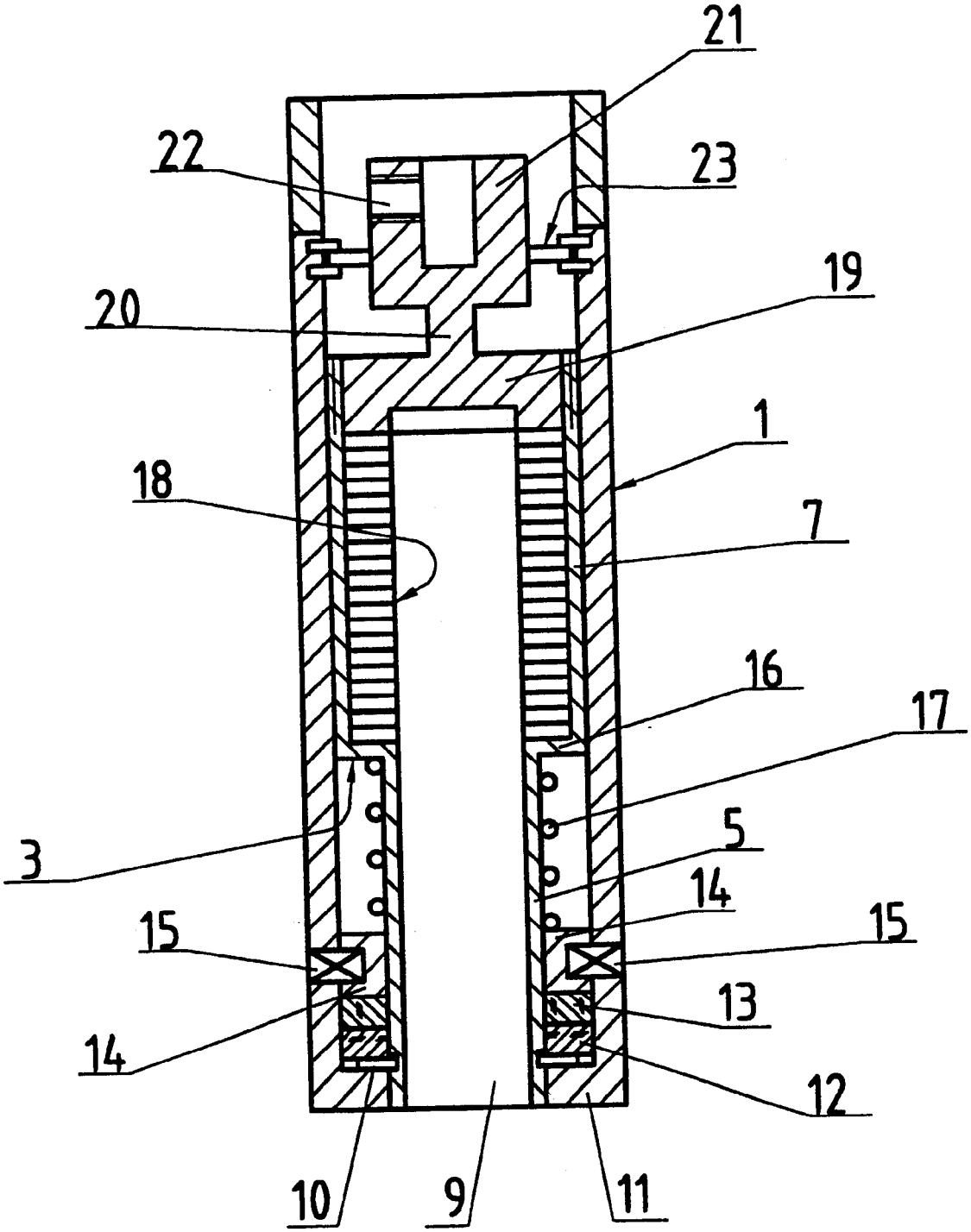
FIG. 1 shows a section through a preferred embodiment of the lock cylinder according to the present invention.
Figure 3:
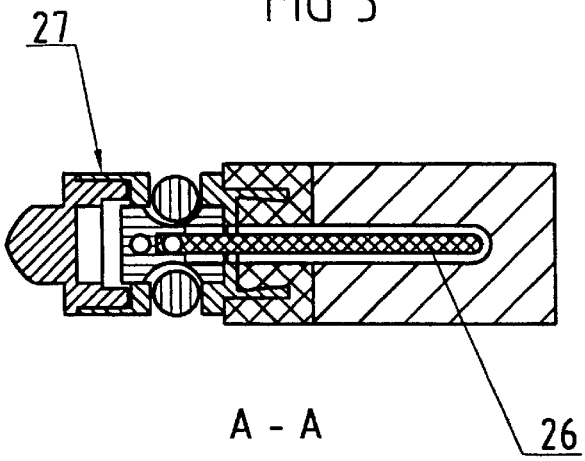
FIG. 3 shows a section along A—A in FIG. 2.

The lock cylinder according to the present invention shown in detail in FIG. 1 comprises an outer cylindric block 1 as well as an inner cylindric block 3, which is turnably received in the outer cylindric block 1. The outer cylindric block 1 has, in principle, a constant diameter along the length thereof while the inner cylindric block 3 has a first portion 5 and a second portion 7, which have different diameters.

The first portion 5 defines inwards a first part of a key hole 9. The inner cylindric block 3 is fixed axially in relation to the outer cylindric block 1 by the fact that said first portion 5 externally, via a groove, is in engagement with a locking washer 10, which preferably is of the snap ring type. In order to hold the locking washer 10 in place, i.e. it is brought to abut against a bent end portion 11 of the outer cylinder 1, two pieces of sliding rings 12 and 13 as well as a ring-shaped holder 14 are arranged, which holder is fixed in the axial direction in relation to the outer cylinder 1 by means of mounting pins 15, which in the shown embodiment are two in number and arranged diametrically in relation to each other. The sliding bearings 12, 13 serve the same purpose as ball bearing.

In the transition section between the first portion 5 and the second portion 7 of the inner cylindric block 3, a step 16 is arranged. A pressure spring 17 extends between the holder 14 and the step 16, said pressure spring 17 exerting a force on the step 16 of the inner cylindric block 3.

Inside the second portion 7 of the inner cylindric block 3, a number of locking function washers 18 are applied, which are intended to co-operate with the bit (not shown) of the key, i.e. the key hole 9 has an extension through said locking function washers 18. When the key is turned, said locking function washers 18 will be turned differently much depending on the design of the bit.

The locking washer 10 has, at the end thereof turned from the inner cylindric block 3, an end portion 19, which, according to the shown embodiment, is fixedly connected to the internal free end of the second portion 7. From the end portion 19, a shaft 20 goes out which in the shown embodiment transforms into a fastening portion 21 for a wire, see for instance FIG. 2, said wire being secured in the fastening portion by means of a locking screw 22. Generally, the fastening portion 21 is called for activating member, in the shown embodiment the fastening portion 21 activating the wire in such a way that it brings the wire to turn when the fastening portion is turned.

If the design of the key bit matches the locking function washers 18, the inner cylindric block 3 may be turned in relation to the outer cylindric block 1, at which in the shown embodiment the fastening portion 21 will be turned and thereby also the wire secured in the fastening portion is turned, the constructive design as well as the constructive function being described more in detail below referring to FIGS. 2 to 7.

Adjacent to the fastening portion 21, a rotation stop 23 is arranged which limits the angle which the fastening portion 21, and thereby the inner cylindric block 3, may be turned in relation to the outer cylindric block 1. The rotation stop 23 may structurally be formed in a plurality of different ways, however, generally, the fastening portion 21 being axially displaceable in relation to the rotation stop 23.

Reference being made to FIGS. 2–7, a locking device for a weapon will now be described, the lock cylinder according to the present invention being included in said locking device.

Figure 2:
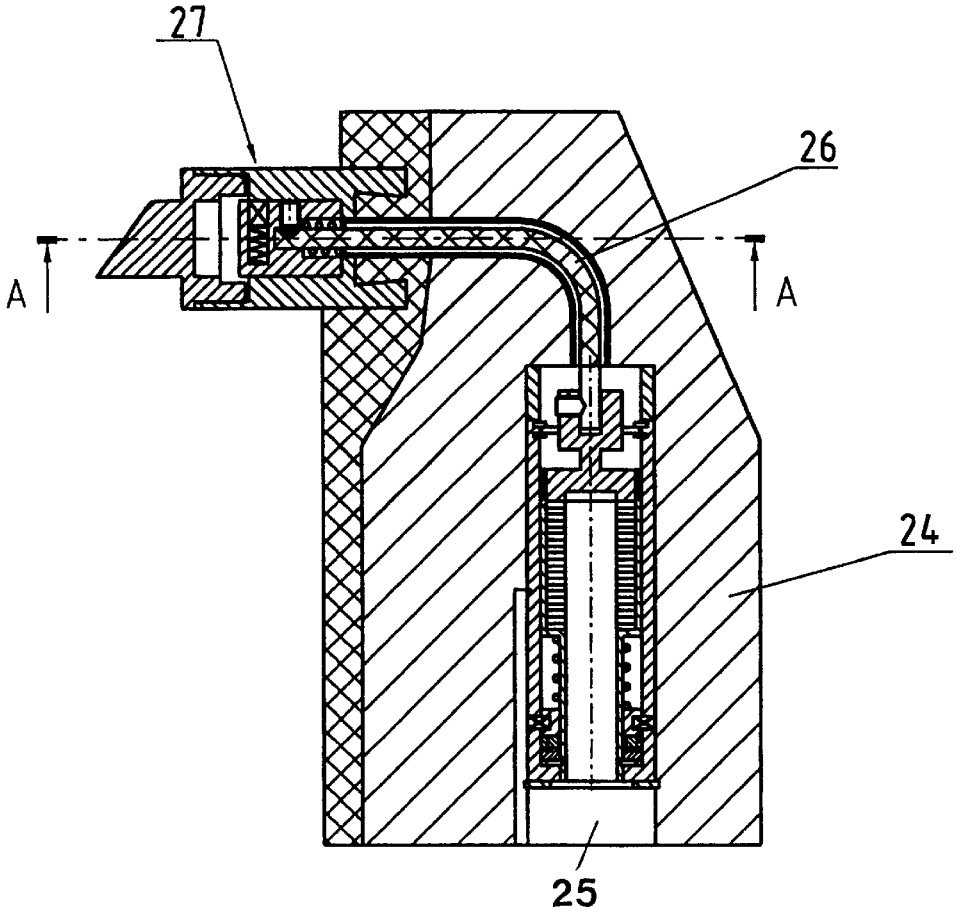
FIG. 2 shows a section through a locking device, in which the lock cylinder according to the present invention is included, said locking device being intended to be mounted in a weapon.
Figure 5:
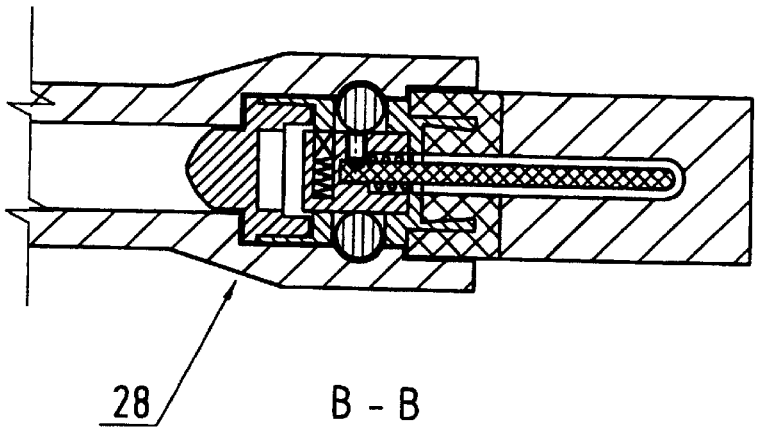
FIG. 5 shows a section along B—B in FIG. 4.
Figure 4:
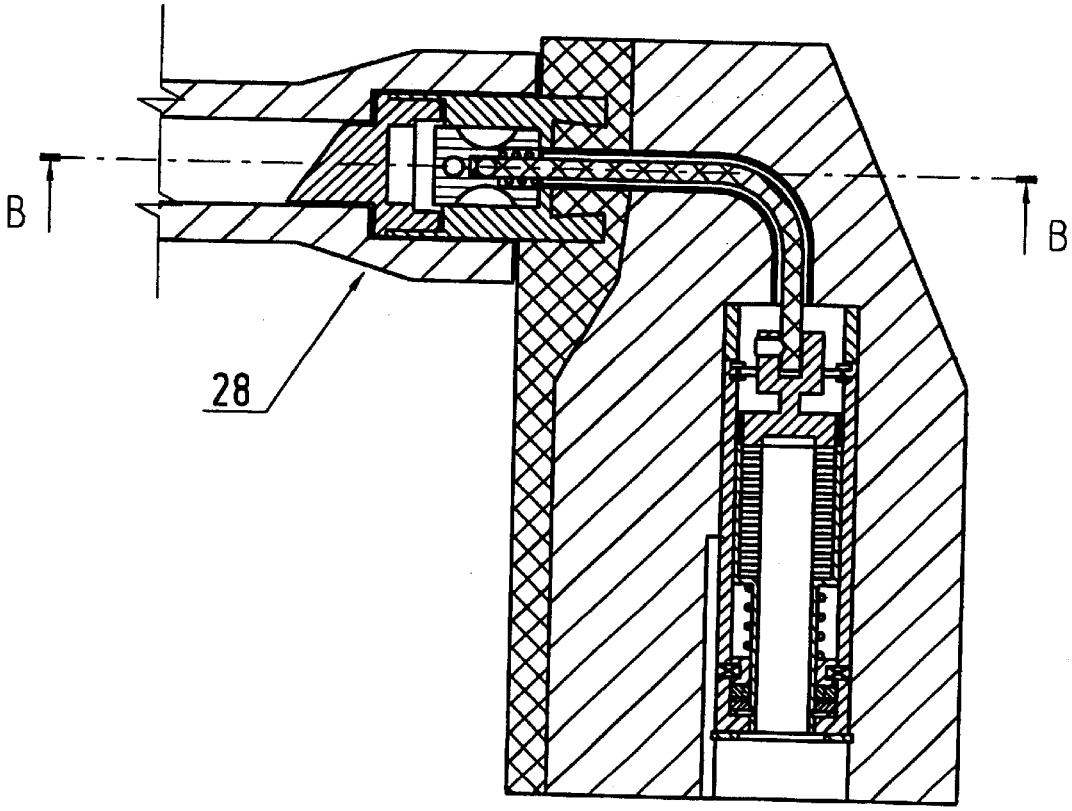
FIG. 4 shows a section through the locking device according to FIG. 2, a part of the locking device being received in a cartridge chamber of the weapon.

As may be seen in FIGS. 2 and 4, the lock cylinder according to the present invention is mounted in an ammunition box dummy 24 which is intended to be applied in an ammunition box holder of the weapon. The lock cylinder according to the present invention is in that connection axially fixed in a boring 25 in the ammunition box dummy 24. From the lock cylinder, the wire 26 already mentioned above extends in a curved duct in the ammunition box dummy 24. The other end of the wire 26 is secured in a lock member 27 which, in the locking device according to FIGS. 2–7, is intended to be received in a cartridge chamber 28 of the weapon, see especially FIGS. 4 and 5. By turning of the wire 26, balls 29 of the lock member 27 co-operates with recesses in the cartridge chamber 28, see especially FIG. 5, the lock member 27 being locked in the cartridge chamber 28.

Figure 7:
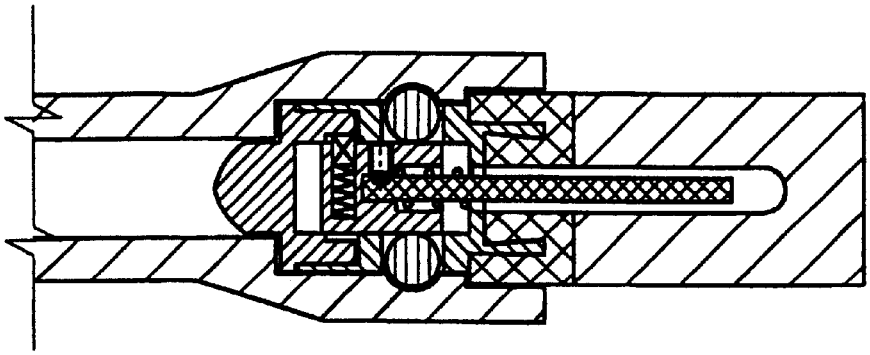
FIG. 7 shows a section along C—C in FIG. 6.
Figure 6:
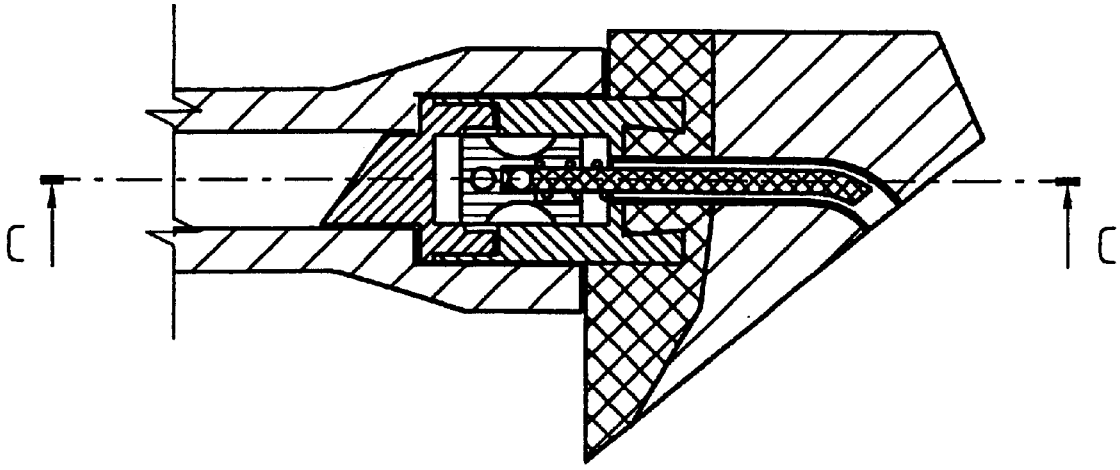
FIG. 6 shows a section, after a wire included in the locking device is cut, through the part of the locking device which is received in the cartridge chamber.

The lock member 27 is so formed that if the wire 26 is cut off, in an attempt to, in an inappropriate way, get access to the weapon, the part of said lock member 27 which co-operates with the balls will be displaced towards the left in FIGS. 6 and 7 by a spring, which means that the lock member 27 is permanently locked in the cartridge chamber 28 also if the wire 26 is turned. The constructive structure of the lock member 27 and the function thereof to jam the lock when the wire 26 is cut off is described more in detail in SE-A-9803819-3.

The Function of the Lock Cylinder According to the Present Invention

In that connection, reference is initially made to FIG. 1. If one imagines that someone does damage to the lock cylinder according to the present invention, for the purpose of trying to reach what the lock cylinder is intended to protect, it is plausible to assume that the person in question tries to bore in the lock cylinder in order to bore away the first portion 5 of the inner cylindric block 3, which entails that the locking function washers 18 may be removed, and then it may be possible to turn the inner cylindric block 3.

If the scenario outlined above is accomplished, i.e. boring is carried out in the lock cylinder according to the present invention, the axial fixation between the inner cylindric block 3 and the outer cylindric block 1 will cease since the engagement between the inner cylindric block 3 and the locking washer 10 (snap ring) are drilled in pieces. In that connection, the pressure spring 17 will displace the inner cylindric block 3 axially in relation to the outer cylindric block 1 in a direction-upwards in FIG. 1. In the exemplified locking device according to FIGS. 2–7, such a displacement will have the corresponding effect as a cutting of the wire 26, i.e. that the lock member 27 is jammed. The fact is that the displacement of the inner cylindric block 3 results in an axial displacement of the wire 26, and thereby an axial displacement of the lock member 27.

In this connection, it should be strongly emphasized that the type of locking device that is shown in FIGS. 2–7 only constitutes an example of a locking device, in which the lock cylinder according to the present invention may be included. Thus, the axial displacement of the inner cylindric block 3 in relation to the outer cylindric block 1 may be used in multiple ways in order to make inappropriate access to the locking device which the lock cylinder according to the present invention is included in more difficult.

For the locking device show in FIGS. 2–7, the wire is connected to a lock member 27, which is applied in the cartridge chamber in a weapon. As an exemplifying and not limiting measure, it may be mentioned that the lock cylinder according to the present invention may be mounted in a door to a safe, wherein the wire may be connected to a lock member applied in the door, which lock member works in principally the same way as the lock member 27 according to FIGS. 2–7, i.e., it is jammed at damage on the lock cylinder.

Within the scope of the invention, it is also possible that the activating member 21 of the lock cylinder according to the present invention at the axial displacement of the inner cylindric block 3 in relation to the outer cylindric block 1 closes an electric circuit, which in turn may release a lock member assuming a locking position.

Fundamental Functional Features of the Present Invention

Said axial displacement of the inner cylindric block 3 in relation to the outer cylindric block 1 is the fundamental functional feature of the lock cylinder according to the present invention when it is exposed to such outer damage that the mutual axial fixation of the inner cylindric block 3 in relation to the outer cylindric block 1 ceases.

What is claimed is:

1. Lock cylinder comprising an outer cylindric block having a first end and a second end, an inner cylindric block that defines a key hole having an opening disposed on a first end of the inner cylindric block, locking function members arranged inside the inner cylindric block, the locking function members being adapted to cooperate with a key insertable in the key hole, an activating member connected to the inner cylindric block, wherein the inner cylindric block is axially displaceable inside the outer cylindric block, the lock cylinder further comprising members for fixing the inner cylindric block and the outer cylindric block in relation to each other in an axial direction such that the first end of the inner cylindric block is disposed proximate the first end of the outer cylindric block, and a force-exerting member, the force-exerting member applying an axial force to the inner cylindric block in the direction away from the first end of the outer cylindric block toward the second end of the outer cylindric block.

2. Lock cylinder according to claim 1, wherein the force-exerting member consists of a pressure spring.

3. Lock cylinder according to claim 1, wherein the inner cylindric block comprises a first portion and a second portion which have different diameters and are interconnected by a step.

4. Lock cylinder according to claim 3, wherein the force-exerting member acts on the step.

5. Lock cylinder according to claim 1, wherein the inner cylindric block is fixed in the axial direction in relation to the outer cylindric block by a locking washer.

6. Lock cylinder according to claim 5, wherein the locking washer is received in an external groove in the inner cylindric block and contacts an abutment on the outer cylindric block.

7. Lock cylinder comprising an outer cylindric block having a first end and a second end, an inner cylindric block that defines a key hole, locking function members arranged inside the inner cylindric block, the locking function members being adapted to cooperate with a key insertable in the key hole, an activating member connected to the inner cylindric block, wherein the inner cylindric block is axially displaceable inside the outer cylindric block, the lock cylinder further comprising members for fixing the inner cylindric block and the outer cylindric block in relation to each other in an axial direction, and a force-exerting member, the force-exerting member applying an axial force to the inner cylindric block in the direction away from an open end of the key hole wherein the inner cylindric block is fixed in the axial direction in relation to the outer cylindric block by a locking washer that is received in an external groove in the inner cylindric block and that contacts an abutment on the outer cylindric block, and at least one sliding bearing member is applied between the locking washer and the abutment.

8. Lock cylinder according to claim 1, wherein the activating member is arranged at a second end of the inner cylindric block.

9. Lock cylinder according to claim 1, further comprising members for limiting turning of the inner cylindric block in relation to the outer cylindric block.

10. Lock cylinder according to claim 2, wherein the inner cylindric block comprises a first portion and a second portion which have different diameters and are interconnected by means of a step.

11. Lock cylinder according to claim 2, wherein the inner cylindric block is fixed in the axial direction in relation to the outer cylindric block by a locking washer.

12. Lock cylinder according to claim 3, wherein the inner cylindric block is fixed in the axial direction in relation to the outer cylindric block by a locking washer.

13. Lock cylinder according to claim 4, wherein the inner cylindric block is fixed in the axial direction in relation to the outer cylindric block by a locking washer.

14. Lock cylinder according to claim 2, wherein the activating member is arranged at a second end of the inner cylindric block.

15. Lock cylinder according to claim 3, wherein the activating member is arranged at a second end of the inner cylindric block.

16. Lock cylinder according to claim 4, wherein the activating member is arranged at a second end of the inner cylindric block.

17. Lock cylinder according to claim 2, further comprising members for limiting turning of the inner cylindric block in relation to the outer cylindric block.

18. Lock cylinder according to claim 3, further comprising members for limiting turning of the inner cylindric block in relation to the outer cylindric block.

19. Lock cylinder according to claim 4, further comprising members for limiting turning of the inner cylindric block in relation to the outer cylindric block.

* * * * *